US005711515A

United States Patent [19]

Nishimura

[11] Patent Number: 5,711,515

[45] Date of Patent: Jan. 27, 1998

[54] WORKPIECE SUPPORT FOR VISE

[75] Inventor: Akira Nishimura, Kanazawa, Japan

[73] Assignee: Kabushiki Kaisha Nishimura Jig, Kanazawa, Japan

[21] Appl. No.: 677,198

[22] Filed: Jul. 9, 1996

[30] Foreign Application Priority Data

Feb. 5, 1996 [JP] Japan ..... 8-019093

[51] Int. Cl.[6] ..... B25B 1/24

[52] U.S. Cl. ..... 269/276; 269/902

[58] Field of Search ..... 269/8, 271, 276, 269/280, 282, 315, 902

[56] References Cited

U.S. PATENT DOCUMENTS

| | | | |
|---|---|---|---|
| 2,666,352 | 1/1954 | Philips | 269/276 |
| 2,948,172 | 8/1960 | Sloboda et al. | 269/276 |
| 3,065,960 | 11/1962 | Miller | 269/276 |
| 4,392,643 | 7/1983 | Campeau | 269/276 |
| 4,569,511 | 2/1986 | Bell, Jr. | 269/276 |
| 5,060,920 | 10/1991 | Engibarov | 269/282 |

FOREIGN PATENT DOCUMENTS

| | | | |
|---|---|---|---|
| 254039 | 8/1964 | Australia | 269/276 |
| 342534 | 2/1960 | Sweden | 269/276 |
| 928879 | 6/1963 | United Kingdom | 269/8 |
| 1313223 | 4/1973 | United Kingdom | 269/276 |

OTHER PUBLICATIONS

"Magnets Hold Wooden Vise–Jaw Liners", The American Machinist, p. 118, Jul. 1958.

"Staggered Construction Improves Magnetic Blocks", The American Machinist, p. 113, Jun. 1949.

"Support Block for Part Inspection", IBM Technical Disclosure Bulletin, p. 743, Nov. 1969.

*Primary Examiner*—Robert C. Watson
*Assistant Examiner*—Thomas W. Lynch
*Attorney, Agent, or Firm*—Oblon, Spivak, McClelland, Maier & Neustadt, P.C.

[57] ABSTRACT

A workpiece support for a vise which is used for clamping a small workpiece on the vise and which can solve the problem that the prior art workpiece support has not versatility in clamping workpieces of various different configurations. In the workpiece support, a magnet is detachably mounted in a support plate and the support plate is fixedly attracted to a jaw plate of the vise through the magnet. Therefore, by forming a step in one side of the support plate along an edge and mounting the magnet in the support plate in a reversible manner, any one surface of the workpiece support can be selected as an attraction surface and the workpiece support can be used in many various forms depending on the workpiece configurations.

4 Claims, 4 Drawing Sheets

WORKPIECE SUPPORT FOR VISE

BACKGROUND OF THE INVENTION 1. (Field of the Invention)

The present invention relates to a workpiece support for a vise which is used for precisely clamping a small workpiece on the vise.

2. (Description of the Prior Art)

When a small workpiece is clamped between jaw plates of a vise while its bottom surface is held in close contact with the base table of the vise, the workpiece to be machined is sometimes positioned such that its upper surface is not projected above the tops of the jaw plates. In such a case, a workpiece support or the so-called spacer plate is often inserted between the workpiece and the base table.

A workpiece support used for that purpose usually comprises a rectangular support plate machined with high precision and a magnet mounted in the support plate. The magnet is embedded in the support plate in an undetachable manner with its attraction surface exposed to the outside at the rear surface of the support plate. The support plate thus constructed is fixed in place while its rear surface is attracted to the surface of the jaw plate through the magnet. The use of the support plate enables the workpiece to be supported at an appropriate position. It is however required to select one of support plates, which has an optimum height (width), depending on the size of the workpiece.

The above-explained prior art has had the problem as follows. Because the magnet is embedded in the support plate in an undetachable manner, the support plate must be always attracted to the jaw plate in the same direction and hence is only able to support workpieces having limited configurations. When supporting a workpiece which has a projection formed at its one end, for example, the support plate is required to have a configuration capable of supporting the workpiece out of interference with the projection. But, the conventional workpiece support is not constructed to be flexibly adapted for such a workpiece of peculiar configuration so that the workpiece can be supported reliably.

SUMMARY OF THE INVENTION

In view of the above-stated problem in the prior art, therefore, an object of the present invention is to provide a workpiece support for a vise in which an attracting magnet can be detachably mounted in a support plate, and the support plate can be fixed at any of its front and rear surfaces to a jaw plate in a reversible manner, thereby easily realizing that the workpiece support can be used in many various forms.

To achieve the above object, a workpiece support for a vise according to the present invention comprises a rectangular support plate and a magnet detachably mounted in the support plate for making the support plate attracted to a jaw plate of the vise.

Preferably, the magnet can be mounted in plural number in the support plate. The plurality of magnets may be of the same size.

The magnet is preferably accommodated and held in a through hole formed in the support plate. Also, the magnet is preferably of the one-side attracting type.

The support plate may have a step formed on one side along an edge, or may have a V-groove formed in a longitudinally extended surface.

With the above arrangements of the present invention, since the magnet is detachably mounted in the support plate and the support plate is fixedly attracted to the jaw plate of the vise through the magnet, desired one of front and rear surfaces of the support plate can be selected as an attraction surface by reversing the direction of the magnet in which it is mounted. In other words, the support plate can be fixed at any one of the front and rear sides to the jaw plate in a reversible manner.

In the case where a plurality of magnets are mounted in the support plate, by changing the number of magnets used, it is possible to change the attraction force of the support plate optionally and adjust the attraction force to be adequate for fixing to the jaw plate. Accordingly, when the support plate is to be fixed to the jaw plate of the vise installed horizontally, for example, the attraction force can be set to be relatively weak so that the support plate is easily placed and removed. On the other hand, when the support plate is to be fixed to the jaw plate of the vise installed vertically or obliquely, the attraction force can be set to be relatively strong so that the support plate is prevented from dropping. Further, when a machined workpiece is released and a vise is then quickly returned to the predetermined position on a high-speed milling machine or the like, a fear of causing a deviation in the position of the support plate is eliminated by increasing the number of magnets to intensify the attraction force.

Where the magnets are of the same size, the attraction force of the support plate can be varied proportionally by increasing or reducing the number of magnets used.

Where the magnet is accommodated and fixed in the through hole formed in the support plate, the magnet can be more positively mounted in the support plate in a detachable manner.

Where the magnet is of the one-side attracting type, cut dust scattered from the workpiece will not adhere onto the surfaces of the magnet and the support plate which are on the non-attracting side, i.e., positioned opposite to the attraction surface of the magnet. In conventional support plates provided with no magnets, it has been required to remove a support plate and clean a vise because cut dust enters the gap between the support plate and a movable or fixed jaw and may bring about an error in the correct positioning of a workpiece in the next operation. By contrast, according to the present invention, since the support plate is moved surely following the movable or fixed jaw of the vise and will not cause any gap therebetween, the cleaning operation is simplified.

With the construction that the support plate has a step formed on one side along an edge, the workpiece support can be used in wider variety of forms by turning over the support plate. Further, by forming a V-groove in the longitudinally extended surface of the support plate, even a workpiece in the form of a round rod can be stably supported with the V-groove.

As stated above, according to the present invention, since desired one of the front and rear surfaces of the support plate can be optionally selected as an attraction surface by selecting the direction in which the magnet is mounted, it is possible to easily use the workpiece support in many various forms depending on the configurations of workpieces and to clamp the workpieces on the vise correctly and stably.

DETAILED DESCRIPTION OF THE PREFERRED EMBODIMENTS

Figure 1:
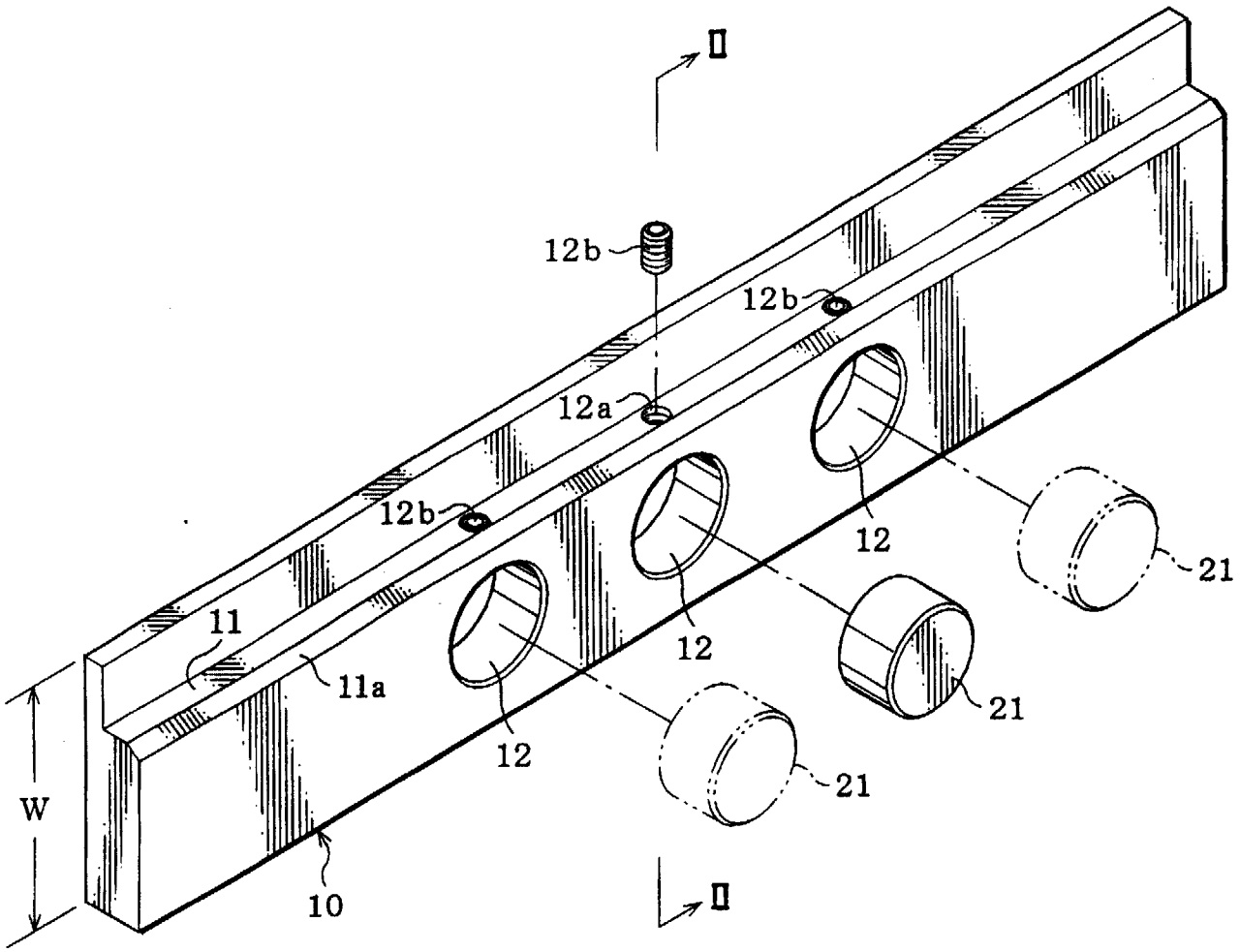
FIG. 1 is an exploded perspective view of a workpiece support of the present invention.
Figure 2:
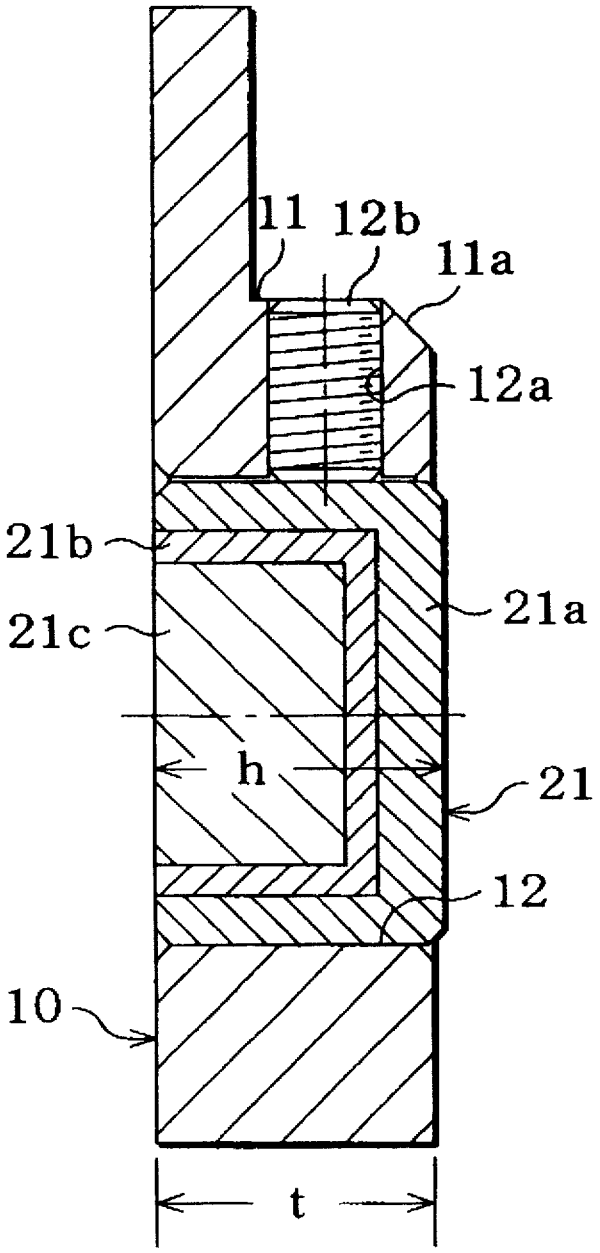
FIG. 2 is a sectional view taken along line II—II in FIG. 1.

Referring to FIGS. 1 and 2, a workpiece support for a vise is of the structure that a magnet 21 can be detachably assembled in a support plate 10.

The support plate 10 is made of a Carbon Steel for Machine Structural Use, such as JIS S45C, which is hard to magnetize. After being entirely quench-hardened to have the hardness of HRC 45–50, the support plate 10 is formed by precision machining into a rectangular plate as a whole. On the front side of the support plate 10, a step 11 is formed along an upper long edge and a ridge portion of the step 11 is chamfered into a slant surface 11*a*. The support plate 10 includes a plurality of through holes 12, 12 . . . which are formed to lie on a line in the longitudinal direction and to be fitted with magnets 21. Peripheral edges of each through hole 12 on the front and rear sides are both chamfered slantly. Threaded holes 12*a*, 12*a* . . . are formed in the step 11 to extend to the corresponding through holes 12, and a set screw 12*b* is screwed into each threaded hole 12*a* to be able to protrude into or retract from the through hole 12.

The magnet 21 comprises a container 21*a* and a permanent magnet 21*c* accommodated in the container 21*a* with a filler 21*b* held therebetween (see FIG. 2). The container 21*a* is a bottom-equipped tubular member made of a steel material and its peripheral edges are chamfered slantly on both the inner and outer sides. The filler 21*b* is made of a hard resin material such as epoxy, phenol or melamine resin. The permanent magnet 21*c* is placed in the container 21*a* such that its magnetic surface is exposed to an opening of the container 21*a* to constitute an attraction surface. But the presence of the filler 21*b* between the permanent magnet 21*c* and the container 21*a* prevents the container 21*a* from being magnetized. Accordingly, the magnet 21 is of the one-side attracting type having an attraction surface defined by the permanent magnet 21*c* on one side.

By inserting the magnet 21 to any one of the through holes 12, 12 . . . and fastening the set screw 12*b*, the magnet 21 can be detachably mounted to the support plate 10 with the attraction surface locating on the rear side of the support plate 10 (see the magnet 21 indicated by solid lines in FIG. 1). In the condition shown in FIG. 1, the set screws 12*b*, 12*b* are screwed into the threaded holes 12*a*, 12*a* communicating with the other through holes 12, 12. Also, in the illustrated embodiment, the magnet 21 is formed to have the height h slightly larger than the thickness t of the support plate 10. Therefore, the magnet 21 is inserted to the through hole 12 such that the attraction surface is flush with the rear surface of the support plate 10. As an alternative, the height h of the magnet 21 may be set to be almost equal to the thickness t of the support plate 10, i.e., h is about equal to t. The magnet 21 can be removed from the through hole 12 by loosening the set screw 12*b*. In addition, by inserting the magnet 21 to the through hole 12 in the direction reversed to the above case, i.e., from the rear side, the magnet 21 can also be attached to the through hole 12 with the attraction surface locating on the front side of the support plate 10.

Furthermore, the support plate 10 can be given any desired degree of attraction force by inserting a desired number of magnets 21, 21 . . . to some or all of the through holes 12, 12 . . . (see the magnets indicated by solid lines and two-dot-chain lines in FIG. 1).

With the workpiece support for a vise constructed as described above, it can be realized to use the workpiece support in many various forms, as shown in FIG. 3, when workpieces Wi(i=1, 2 . . . ) are clamped on a vise V. The vise V comprises a fixed jaw V2 provided at one end of a base V1 and a movable jaw V3 provided in opposite relation to the fixed jaw V2 to be able to move back and forth on the upper surface of the base V1. Jaw plates V2*a*, V3*a* are attached respectively to the front surfaces of the fixed jaw V2 and the movable jaw V3.

Figure 3C:
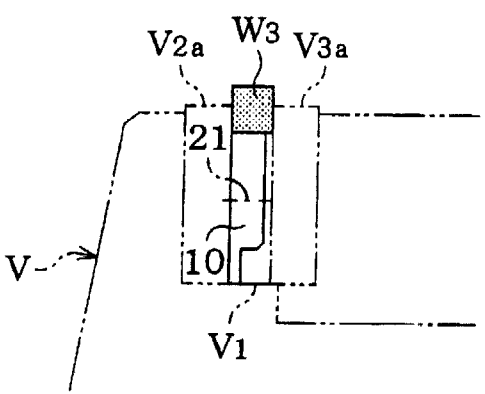
FIGS. 3(A) to 3(F) are explanatory views showing various forms in which the workpiece support of the present invention is used.
Figure 3B:
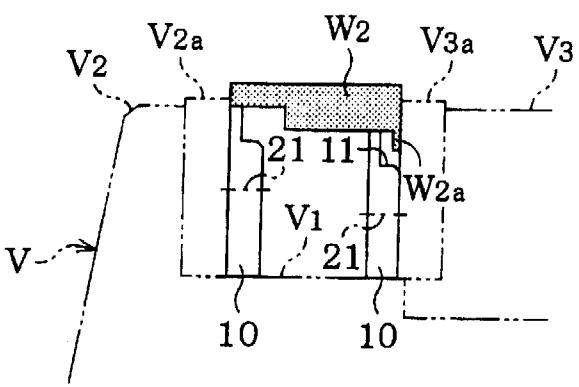
Figure 3A:
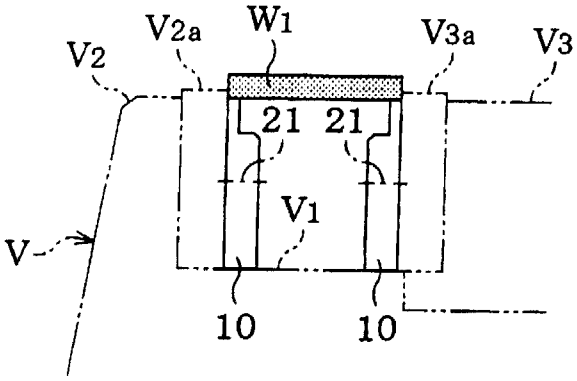

When clamping a thin plate-shaped workpiece W1 on the vise V, as shown in FIG. 3(A), two support plates 10, 10 being slightly lower (narrower) than the height of the jaw plates V2*a*, V3*a* are first selected. Then, the support plates 10, 10 are placed on the base V1 and fixed to the jaw plates V2*a*, V3*a* through the magnets 21, 21, respectively. At this time, the support plates 10, 10 are fixed to the jaw plates V2*a*, V3*a* such that their front surfaces are exposed to the outside. From this condition, the movable jaw V3 is advanced, the workpiece W1 is set on the support plates 10, 10, and thereafter the movable jaw V3 is fastened. As a result, the workpiece W1 can be supported at an appropriate level by the support plates 10, 10 and simultaneously stably clamped on the vise V through the jaw plates V2*a*, V3*a*.

When clamping a workpiece W2 having a stepped cross-section, as shown in FIG. 3(B), two support plates 10, 10 of different heights (widths) are employed and one of the support plates is turned over. The workpiece W2 can be supported out of interference with a rib W2*a* by utilizing the step 11 of the support plate 10 which is turned over.

As shown in FIG. 3(C), a small key-shaped workpiece W3 can be supported by using one support plate 10 turned upside down. In this case, the support plate 10 may be fixed to any one of the jaw plates V2*a*, V3*a*. Also, a workpiece W4 having a similar configuration as the workpiece W3 can be supported by using a plurality of support plates 10, 10 . . . arranged vertically and horizontally in a proper combination (see FIG. 3(D)). It is to be noted that, for the support plate 10 shown in FIG. 3(D) as including no magnets 21, the magnet 21 is not inserted to any through hole 12. Further, for the two support plates 10, 10 held in close contact with each other on the side of the jaw plate V2*a*, one plate is fixedly attracted through the magnet 21 to the other plate which is in turn fixed to the jaw plate V2*a* through the magnet 21.

Figure 3F:
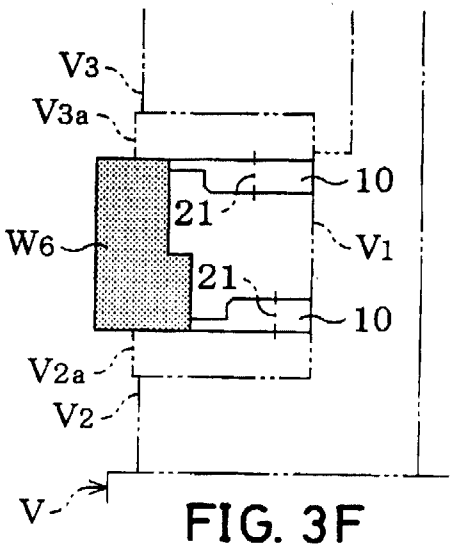
Figure 3E:
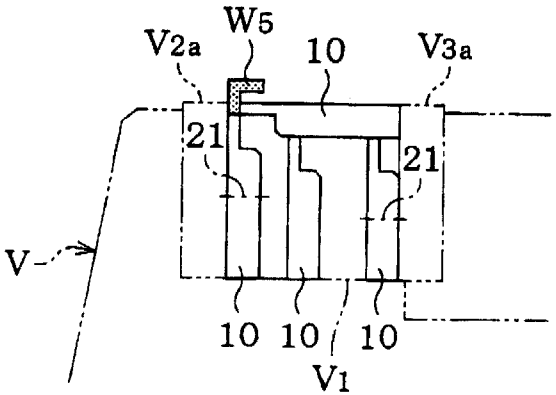
Figure 3D:
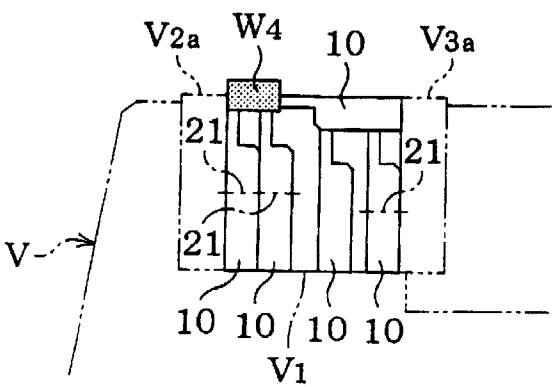

As shown in FIG. 3(E), a small workpiece W5 having an L-shaped cross-section can be supported by utilizing the ends of two support plates 10, 10 arranged vertically and horizontally, the ends being abutted to define two faces perpendicular to each other. More specifically, the workpiece W5 is clamped on the vise V through the support plate 10 fixed to the jaw plate V2*a*, the jaw plate V2*a*, and the support plate 10 supported horizontally by both the support plate 10 fixed to the jaw plate V3*a* and the support plate 10 arranged vertically on the base V1.

As shown in FIG. 3(F), a stepped workpiece W6 can be supported by using two support plates 10, 10 of different widths fixed respectively to the jaw plate V2*a*, V3*a*. Note that the vise V is here installed vertically. It is therefore preferred that a plurality of magnets 21, 21 . . . be mounted in the support plate 10 fixed to the jaw plate V3*a* of the upper movable jaw V3, for assuring a large attraction force. Incidentally, the vise V may be installed obliquely.

Thus, the workpieces Wi having a wide variety of configurations can be positively and stably supported by selecting the support plate 10 which has an appropriate width W, turning over the support plate, turning the support plate upside down, selecting a desired number of magnets 21, 21 . . . mounted in the support plate 10, and/or employing one or two or more support plates in a proper combination. The attraction force of the support plate 10 can be adjusted by selecting the number of magnets 21, 21 . . . mounted in the support plate 10. Because of the support plate 10 being of the one-side attracting type, when the support plate 10 is fixedly attracted to the jaw plate V2*a*, V3*a*, etc., its surface on the side that is subjected to cut dust scattered from the workpiece Wi is a non-attracting surface and, therefore, no cut dust will adhere onto the workpiece support.

Another Embodiment

Figure 4:
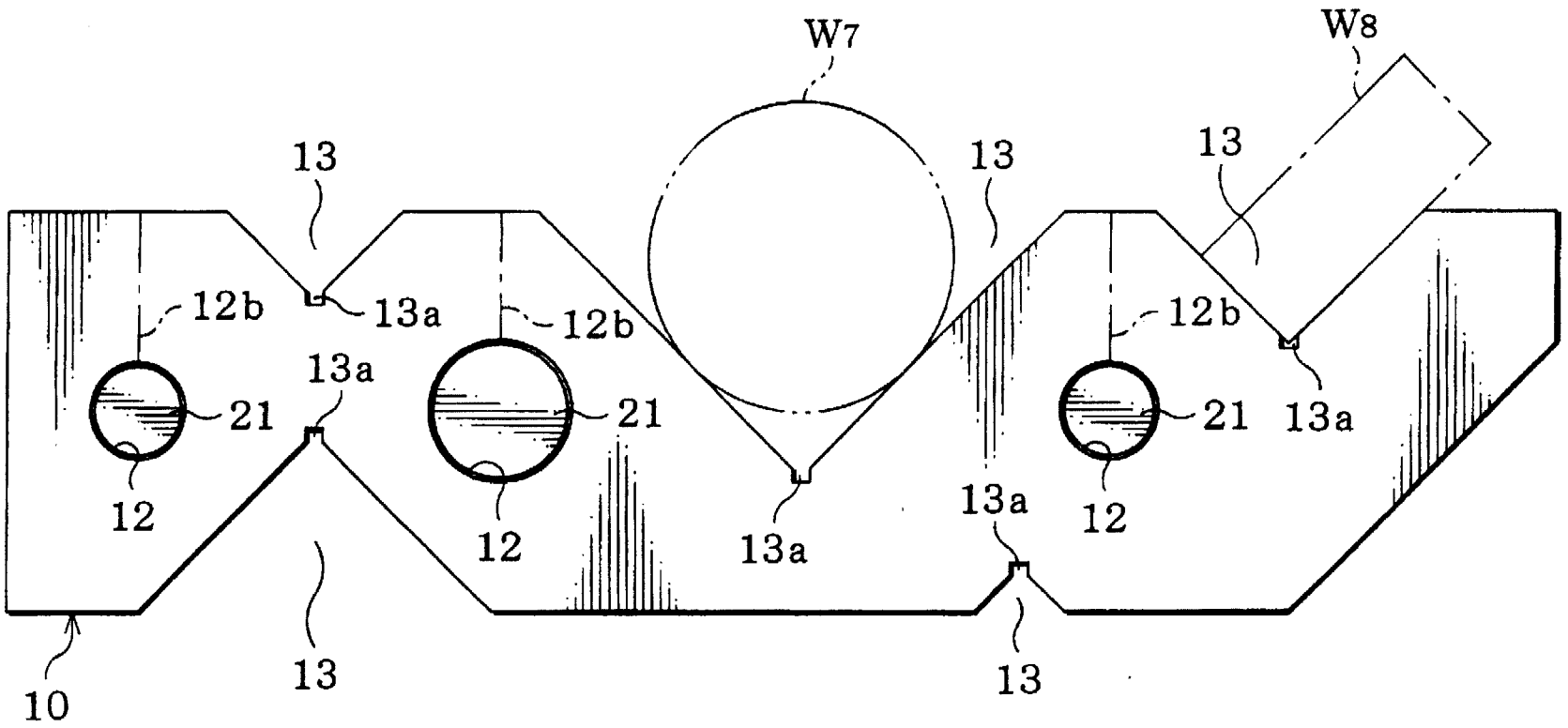
FIG. 4 is a front view showing another embodiment of the present invention.

As shown in FIG. 4, the support plate 10 can be constructed of an elongate plate formed with V-grooves 13, 13 . . . of different depths in both longitudinally extended surfaces, i.e., upper and lower surfaces, instead of the step 11 in the foregoing embodiment. A small groove 13*a* is formed at the bottom of each V-groove 13. Further, through holes 12, 12 of small diameter and a through hole 12 of large diameter are formed in the support plate 10. Magnets 21, 21 . . . can be each detachably fitted to corresponding one of the through holes 12. In other words, by assembling the small magnet 21 into any one of the small-diameter through holes 12 on the left and right sides, the attraction force generated by the support plate 10 is minimized. Also, by assembling the magnets 21 into all of the small-diameter through holes 12, the support plate 10 produces the maximum attraction force.

The support plate 10 can stably support a workpiece W7 in the form of a round rod by selecting proper one of the V-grooves 13 (see two-dot-chain lines in FIG. 4). The support plate 10 can also obliquely support a workpiece W8 in the form of a square pillar by utilizing proper one of the V-grooves 13 with the small groove 13*a* (see one-dot-chain lines in FIG. 4).

In the above description, the number of the through holes 12 formed in the support plate 10 may be one or two or more any desired number. The plurality of through holes 12, 12 . . . may be a combination of holes having any desired different diameters. Further, the support plate 10 shown in FIG. 4 may additionally include the step 11 as with the support plate of FIG. 1.

The workpiece support for a vise according to the present invention can be more convenient in practical use by preparing a combined set of multiple support plates 10, 10 . . . which are formed to have widths W increased in units of predetermined amount in accordance with an appropriate series of numerical values, for example, and corresponding magnets 21, 21 . . . in an appropriate number.

What is claimed is:

1. A workpiece support for a vise, the workpiece support comprises:

a rectangular support plate with a plurality of through holes formed thereon, the plurality of through holes extending in a thickness direction of the rectangular support plate; and a plurality of magnets detachably fitted into the plurality of through holes for attaching the rectangular support plate to a jaw plate of the vise when the magnets are fitted into the through holes, and the magnets are of one-side attracting type.

2. A workpiece support for a vise according to claim 1, wherein said plurality of magnets are of the same size.

3. A workpiece support for a vise according to claim 2, wherein the rectangular support plate has a step formed on one side thereof to accommodate a workpiece.

4. A workpiece support for a vise according to any one of claims 1 or 2, wherein the rectangular support plate has a V-groove formed in a longitudinally extending surface for accommodating a workpiece.

* * * * *